US008789890B2

(12) United States Patent
Iwata et al.

(10) Patent No.: US 8,789,890 B2
(45) Date of Patent: Jul. 29, 2014

(54) ABRASION DETECTING APPARATUS DETECTING ABRASION OF COMPONENT OF CUTTER HEAD AND TUNNEL BORING MACHINE INCLUDING ABRASION DETECTING APPARATUS

(75) Inventors: Hiroyoshi Iwata, Kobe (JP); Yasunori Kondo, Kakogawa (JP); Yoshio Sakai, Kobe (JP); Taso Aimi, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 232 days.

(21) Appl. No.: 12/844,396

(22) Filed: Jul. 27, 2010

(65) Prior Publication Data

US 2011/0031017 A1 Feb. 10, 2011

(30) Foreign Application Priority Data

Aug. 4, 2009 (JP) ..... 2009-181843

(51) Int. Cl.
*E21D 9/10* (2006.01)
*E21D 9/00* (2006.01)
*E21B 12/02* (2006.01)

(52) U.S. Cl.
CPC ..... *E21D 9/003* (2013.01); *E21D 9/104* (2013.01); *E21B 12/02* (2013.01)
USPC ..... 299/1.8; 405/138; 175/40

(58) Field of Classification Search
CPC ..... E21D 9/003; E21D 9/10; E21D 9/104; E21B 12/02
USPC ..... 299/1.05, 1.1, 1.2, 1.4, 1.8; 405/138; 175/40
See application file for complete search history.

(56) References Cited

U.S. PATENT DOCUMENTS 3,800,278 A * 3/1974 Jaye et al. ..... 340/454
4,884,434 A * 12/1989 Satake et al. ..... 73/7
4,911,252 A * 3/1990 Estes ..... 175/39

(Continued)

FOREIGN PATENT DOCUMENTS

JP U-5-14299 2/1993
JP A-6-117188 4/1994

(Continued)

OTHER PUBLICATIONS

"Robbins Trio Dig Deep in Mexico". World Tunneling. Apr. 2009.*
Robbins_Drawing_spec. Robbins. 2009.*

*Primary Examiner* — David Bagnell
*Assistant Examiner* — Michael Goodwin
(74) *Attorney, Agent, or Firm* — Oliff PLC

(57) ABSTRACT

An abrasion detecting apparatus is configured to detect the abrasion of a component of a cutter head of a tunnel boring machine, which is configured to excavate ground using a cutter to bore a tunnel. The abrasion detecting apparatus includes an abrasion detection probe located rearward of a front end of the cutter by a predetermined distance and located forward or rearward of a front end of the component, whose abrasion is to be detected, of the cutter head by a predetermined distance, where the abrasion detection probe includes an abrasion detecting portion at a front end portion thereof. The abrasion detecting portion abrades away by contact with the ground to be excavated. The abrasion detecting apparatus also includes a detecting device configured to detect an abrasion of the abrasion detecting portion.

8 Claims, 10 Drawing Sheets

(56) References Cited

U.S. PATENT DOCUMENTS

| | | | | |
|---|---|---|---|---|
| 5,924,499 | A * | 7/1999 | Birchak et al. | 175/40 |
| 6,347,838 | B1 * | 2/2002 | Mukaidani et al. | 299/55 |
| 8,172,334 | B2 * | 5/2012 | Lindbergh et al. | 299/1.8 |
| 2002/0092680 | A1 * | 7/2002 | Palaschenko | 175/57 |
| 2008/0000687 | A1 * | 1/2008 | Xu et al. | 175/39 |
| 2008/0024000 | A1 * | 1/2008 | Moulin et al. | 299/1.05 |

FOREIGN PATENT DOCUMENTS

| | | |
|---|---|---|
| JP | B2-6-63423 | 8/1994 |
| JP | A-10-221005 | 8/1998 |
| JP | A-2003-74295 | 3/2003 |
| JP | A-2007-092520 | 4/2007 |

* cited by examiner

ABRASION DETECTING APPARATUS DETECTING ABRASION OF COMPONENT OF CUTTER HEAD AND TUNNEL BORING MACHINE INCLUDING ABRASION DETECTING APPARATUS

BACKGROUND OF THE INVENTION

1. Field of the Invention

The present invention relates to an abrasion detecting apparatus configured to detect abrasion of a component, such as a roller cutter, of a cutter head and a tunnel boring machine including the abrasion detecting apparatus.

2. Description of the Related Art

Conventionally, a cutter head of a tunnel boring machine configured to excavate hard ground, such as rock, is provided with roller cutters (also referred to as roller bits or disc cutters) configured to crush and excavate the ground. By pressing the roller cutters against the ground and rotating the cutter head, the rotating roller cutters crush a cutting face to excavate the hard ground.

In accordance with such tunnel boring machine, a cutting edge of each roller cutter abrades away as tunnel excavation proceeds. Therefore, an abrasion loss of the roller cutter is measured every time the tunnel boring machine excavates for a predetermined distance, and the roller cutter needs to be replaced with a new one if its abrasion loss exceeds an acceptable value.

Here, inventions have already been filed, in each of which the abrasion loss of the roller cutter is mechanically detected, and whether or not the roller cutter needs to be replaced with a new one is monitored by a tunnel boring machine main body. For example, the present applicant has already filed an application in which a detecting element is pressed against an outer periphery of the roller cutter by an oil-pressure jack, and the abrasion loss of the roller cutter is detected based on a change in a stroke of the oil-pressure jack (see Japanese Laid-Open Patent Application Publication No. 2003-74295, for example).

Moreover, there is another prior art in which a small jack is provided to be able to project and contact the cutting edge of the roller cutter, and the abrasion of the roller cutter is detected by observing the amount of projection of the small jack using an endoscope (see Japanese Laid-Open Patent Application Publication No. 6-117188, for example).

Further, there is yet another prior art in which the abrasion loss of the roller cutter is obtained such that: a magnetic scale is provided inside a hub which holds the roller cutter; a rotation detector is provided at a shaft; the rotation detector detects the number of rotations of the roller cutter; and the diameter of the cutter is calculated from the number of rotations (see Japanese Laid-Open Utility Model Application Publication No. 5-14299, for example).

Although this is not a technology which mechanically detects the abrasion loss of the roller cutter, there is still another prior art in which in order to prevent the cutter bit of a shield machine or an aboveground structure from being damaged such that the cutter bit hits an obstacle, such as a pile, an obstacle detecting bit is provided to project forward of the cutter bit, a fluid pressure supply system configured such that fluid pressure is released if the obstacle detecting bit drops off is adjacently provided, and a pressure detecting means detects the fluid pressure of the fluid pressure supply system to detect drop-off of the obstacle detecting bit (see Japanese Examined Patent Application Publication No. 6-63423).

SUMMARY OF THE INVENTION

However, in accordance with Japanese Laid-Open Patent Application Publication 2003-74295, the abrasion cannot be detected if the roller cutter is not still, and an abrasion status cannot be monitored during the excavation. Moreover, for example, in a case where the roller cutter cannot rotate, and a partial abrasion occurs at a front surface portion of the roller cutter, such abrasion may not be detected, and a holding portion of the roller cutter may abrade away.

Further, in accordance with Japanese Laid-Open Patent Application Publication No. 6-117188, precision instruments, such as the endoscope and a cleaning nozzle, are provided at the holding portion of the roller cutter, through which portion crushed gravel, sand, and the like move. Therefore, there is an extremely high possibility that these instruments break down by vibrations during the excavation or the moving gravel, sand, and the like, so that these instruments cannot perform observation. In addition, it is extremely difficult to clean the sand, gravel, and the like of a measuring portion and accurately measure the abrasion status.

Moreover, in accordance with Japanese Laid-Open Utility Model Application Publication No. 5-14299, the abrasion loss of the roller cutter whose periphery does not always uniformly abrade away by crushing the ground is calculated from a difference between the outer diameter of the roller cutter which diameter is obtained by calculation and the outer diameter of the brand-new roller cutter. Therefore, it is difficult to highly accurately calculate the abrasion loss of the actual roller cutter which nonuniformly abrades away. In addition, the outer diameter of the roller cutter is calculated on the basis that slip or spin does not occur between the roller cutter and the ground. However, the slip and the spin actually occur to some extent, and this also causes errors. Further, since an abrasion detection probe needs to be incorporated in the roller cutter, a dedicated roller cutter needs to be manufactured. This causes a significant cost increase, and it is difficult to realize such configuration.

Further, in accordance with Japanese Examined Patent Application Publication No. 6-63423, it is possible to detect obstacles in a soft ground which is excavated by the shield machine. However, it is impossible to detect the abrasion or damage of for example, the roller cutter which excavates a hard ground.

As above, it is difficult for the conventional technology to stably and mechanically measure the abrasion loss of the roller cutter, such as during the excavation. Actually, in most cases, the abrasion loss of the roller cutter is manually measured by workers.

However, the abrasion loss of the roller cutter needs to be measured by the worker after all the sand and gravel around the roller cutter is discharged and the stability of the surrounding ground is confirmed. Therefore, this measuring operation requires comparatively much time. During this operation, the tunnel boring machine stops, so that the excavation efficiency deteriorates. Especially, in the tunnel boring machine, such as a slurry type/earth pressure balanced type tunnel boring machine, which excavates with a cutting face side sealed and a predetermined pressure applied, the measurement of the abrasion loss of the roller cutter under pressure is difficult. Therefore, after slurry or mud in a chamber is discharged, for example, surrounding ground improvement (prevention of flood and falling of the ground) needs to be performed, and cleaning of the chamber needs to be carried out. This is troublesome and requires much time and labor. Thus, the efficiency further deteriorates.

In recent years, the cutter head of the tunnel boring machine may be provided with a tool bit in addition to the roller cutter in case a soft ground appears during the excavation of the hard ground. Therefore, there is a need for the measurement of the abrasion loss of the tool bit and the detection of the abrasion of the other component of the cutter head.

Here, an object of the present invention is to provide an abrasion detecting apparatus capable of detecting the abrasion of the component, such as the roller cutter, of the cutter head without the worker getting into the chamber, and a tunnel boring machine including such abrasion detecting apparatus.

To achieve the above object, an abrasion detecting apparatus according to the present invention is configured to detect an abrasion of a component of a cutter head of a tunnel boring machine configured to excavate a ground using a cutter to bore a tunnel, the abrasion detecting apparatus including: an abrasion detection probe including an abrasion detecting portion at a front end portion thereof, the abrasion detecting portion abrading away by contact with the ground to be excavated, the abrasion detection probe being located rearward of a front end of the cutter by a first distance and located forward or rearward of a front end of a component, whose abrasion needs to be detected, of the cutter head by a second distance; and a detecting device configured to detect an abrasion of the abrasion detecting portion. In the present description and claims, a direction in which the cutter head excavates is defined as "forward" whereas a direction in which the tunnel boring machine main body is provided when viewed from the cutter head is defined as "rearward". Moreover, in the present description and claims, the phrase "component whose abrasion needs to be detected" is each of various components provided at the cutter head and components constituting the cutter head.

With this, by detecting the abrasion of the abrasion detecting portion, the abrasion of the component, such as the roller cutter, of the cutter head can be recognized even during the rotation of the cutter head. The labor of an operation of measuring the abrasion loss of the component of the cutter head can be saved, and the time of this operation can be reduced. Thus, for example, the replacement of the abraded component can be efficiently carried out.

Moreover, the abrasion detection probe may be detachably attached to the cutter head.

With this, by replacing the abrasion detection probe having the abraded abrasion detecting portion at its tip end with a new one, the new abrasion detection probe can serve as the abrasion detection probe at the position.

Further, the abrasion detection probe may be provided on a rotational trajectory of the component whose abrasion is detected.

With this, the abrasion of the component of the cutter head can be detected by the abrasion detection probe provided at any position on the rotational trajectory of this component. Therefore, the abrasion detection probe can be provided at a preferable position.

Moreover, the abrasion detection probe may be provided on the rotational trajectory of each of a plurality of components of the cutter head.

With this, the abrasion of each of the plurality of components of the cutter head can be detected by the abrasion detection probe provided at any position on the rotational trajectory of this component. Therefore, the abrasion detection probes can be provided at preferable positions corresponding to the plurality of components.

Further, the abrasion detecting portion may be provided at a position which is located rearward of a front end of a roller cutter provided at the cutter head by a certain distance and corresponds to a set abrasion loss of the roller cutter.

With this, the abrasion detection apparatus can stably detect that the abrasion loss of the roller cutter, which abrades away most among the components of the cutter head, has reached the set abrasion loss.

Moreover, each of the abrasion detection probes may be provided on a rotational trajectory of each of a plurality of the roller cutters provided at the cutter head such that the abrasion detection probes are arranged in a radial direction of the cutter head.

With this, the abrasion detecting apparatus can stably detect that the abrasion loss of any of a plurality of roller cutters, which are provided at the cutter head to have different rotation radiuses, has reached the set abrasion loss.

Further, the abrasion detecting portion may be provided at a position which is located rearward of a front end of a tool bit provided at the cutter head by a certain distance and corresponds to a set abrasion loss of the tool bit.

With this, the abrasion detecting apparatus can stably detect that the abrasion loss of the tool bit provided at the cutter head has reached the set abrasion loss.

Moreover, the abrasion detecting portion may be provided at a position which is located forward of a front end of a cutter head frame of the cutter head by a certain distance.

With this, the cutter head frame, which is almost irreplaceable among the components of the cutter head, can be prevented from abrading away.

Further, the abrasion detection probe may be constituted by a fluid-pressure type detection probe configured to detect based on a change in a fluid pressure that the abrasion loss of the abrasion detecting portion has reached the set abrasion loss, and the fluid-pressure type detection probe may be configured to apply a predetermined fluid pressure to the abrasion detecting portion and detect based on a reduction in the fluid pressure that the abrasion loss of the abrasion detecting portion has reached the set abrasion loss.

With this, the abrasion can be detected by the reduction in the fluid pressure applied to the abrasion detecting portion. The detection probe which is comparatively simple in configuration and low in cost can be configured by utilizing the fluid pressure used for, for example, driving the cutter head.

Moreover, the abrasion detection probe may be constituted by an ultrasound type detection probe configured to detect based on an ultrasound propagation time that the abrasion loss of the abrasion detecting portion has reached the set abrasion loss, and the ultrasound type detection probe may be configured to include an ultrasound probe in the abrasion detecting portion and detect based on the ultrasound propagation time by the ultrasound probe that the abrasion loss of the abrasion detecting portion has reached the set abrasion loss.

With this, it is possible to configure the detection probe capable of measuring the ultrasound propagation time of the abrasion detecting portion, detecting the abrasion loss based on the change in the propagation time, and continuously measuring the change in the abrasion loss.

Further, the abrasion detection probe may be constituted by an electric type detection probe configured to detect based on a change in an electrical resistance value that the abrasion loss of the abrasion detecting portion has reached the set abrasion loss, and the electric type detection probe may be configured to include electric wires in the abrasion detecting portion and detect based on a change in an electrical resistance value between the electric wires that the abrasion loss of the abrasion detecting portion has reached the set abrasion loss.

With this, it is possible to configure the detection probe which is capable of detecting the abrasion loss by the change in the electrical resistance value of the abrasion detecting portion and is comparatively simple in configuration and low in cost.

Meanwhile, a tunnel boring machine according to the present invention includes: the abrasion detecting apparatus described above; and a display apparatus configured to display a detection result of the abrasion detecting apparatus.

With this, the abrasion of the component, such as the roller cutter, of the cutter head can be visually confirmed by the display apparatus which displays as the detection result that the abrasion loss of the abrasion detecting portion has reached the set abrasion loss. Then, the replacement of the roller cutter and the like is efficiently carried out by workers, and the tunnel boring machine can be operated while suppressing the decrease in efficiency of the excavation.

DESCRIPTION OF THE PREFERRED EMBODIMENTS

Hereinafter, one embodiment of the present invention will be explained based on the drawings. The following embodiment will explain, as an example, a tunnel boring machine including roller cutters configured to excavate a hard ground and tool bits configured to excavate a soft ground.

Figure 1:
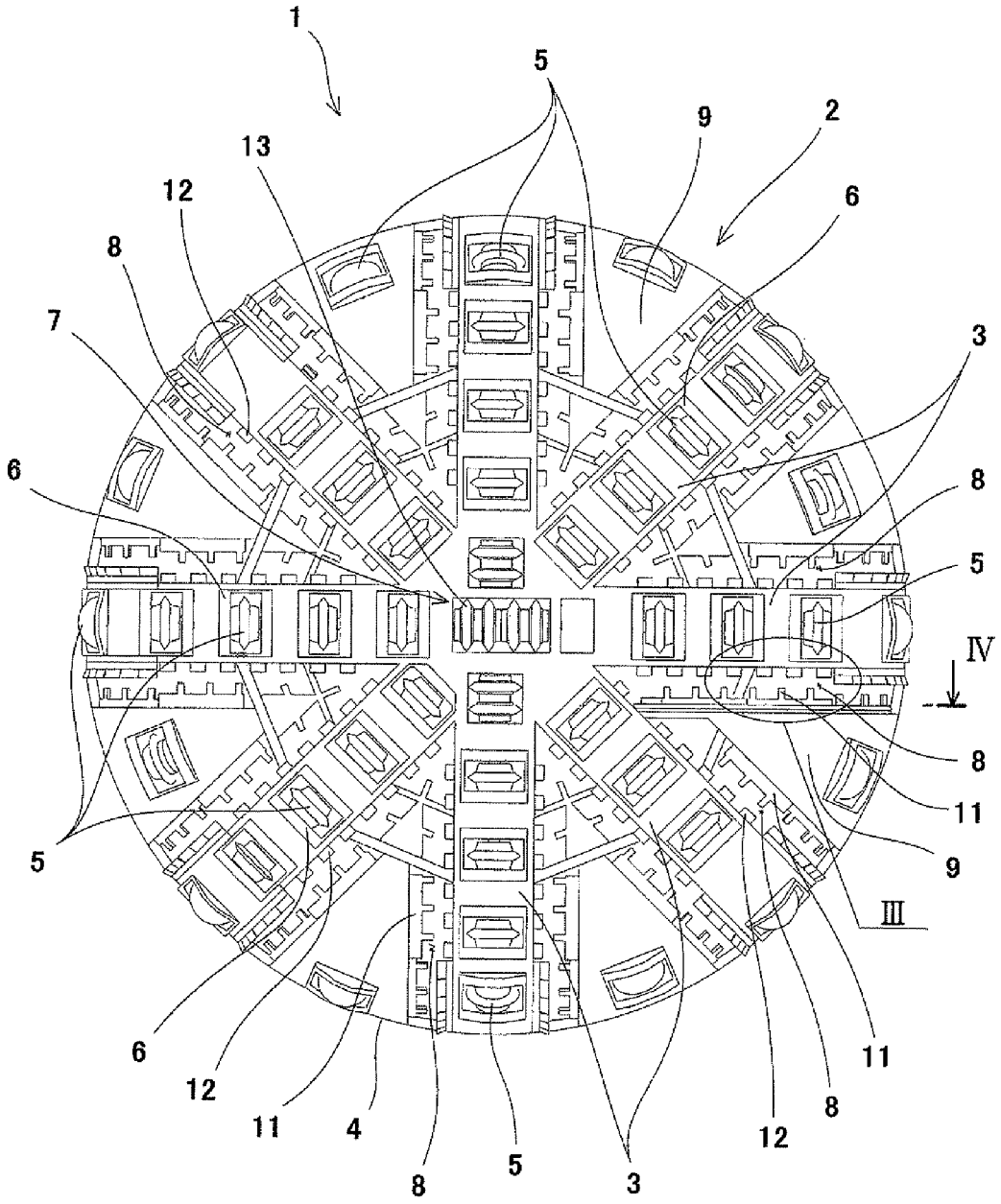
FIG. 1 is a front view of a tunnel boring machine including one embodiment of an abrasion detecting apparatus according to the present invention.

As shown in FIG. 1, a cutter head 2 of a tunnel boring machine 1 of the present embodiment includes a plurality of cutter head frames 3 radially extending from a center portion of the cutter head 2. These cutter head frames 3 and an outer peripheral frame 4 are coupled to one another to form an outer shape of the cutter head 2. Here, the cutter head 2 denotes an entire turning head provided at a front portion of the tunnel boring machine 1. A plurality of roller cutters 5 are provided at the cutter head frame 3 in a radial direction. These roller cutters 5 are provided at the cutter head 2 by cutter holders 6 each configured to rotatably support the roller cutter 5. Moreover, these roller cutters 5 are arranged in the radial direction, so that respective roller cutters 5 rotate to have different rotation radiuses. Moreover, a center cutter 7 in which a plurality of roller cutters 13 are arranged in parallel with one another is provided at the center portion of the cutter head 2. An interval between adjacent roller cutters 5, the number of roller cutters 5, the positions of the cutter head frames 3, the components of the center cutter 7, and the like are determined depending on an excavation diameter, a ground condition (ground) to be excavated, and the like.

Moreover, sand intake ports 8 are provided on both sides of each cutter head frame 3. A portion between adjacent sand intake ports 8 is closed by a face plate 9. A slit adjusting plate 11 is provided at the sand intake port 8. The slit adjusting plate 11 adjusts the size of an opening such that the sand, the gravel, and the like taken in a chamber 10 (FIG. 2) behind the cutter head 2 have appropriate sizes so as to be able to be discharged rearward of the tunnel boring machine.

Figure 5:
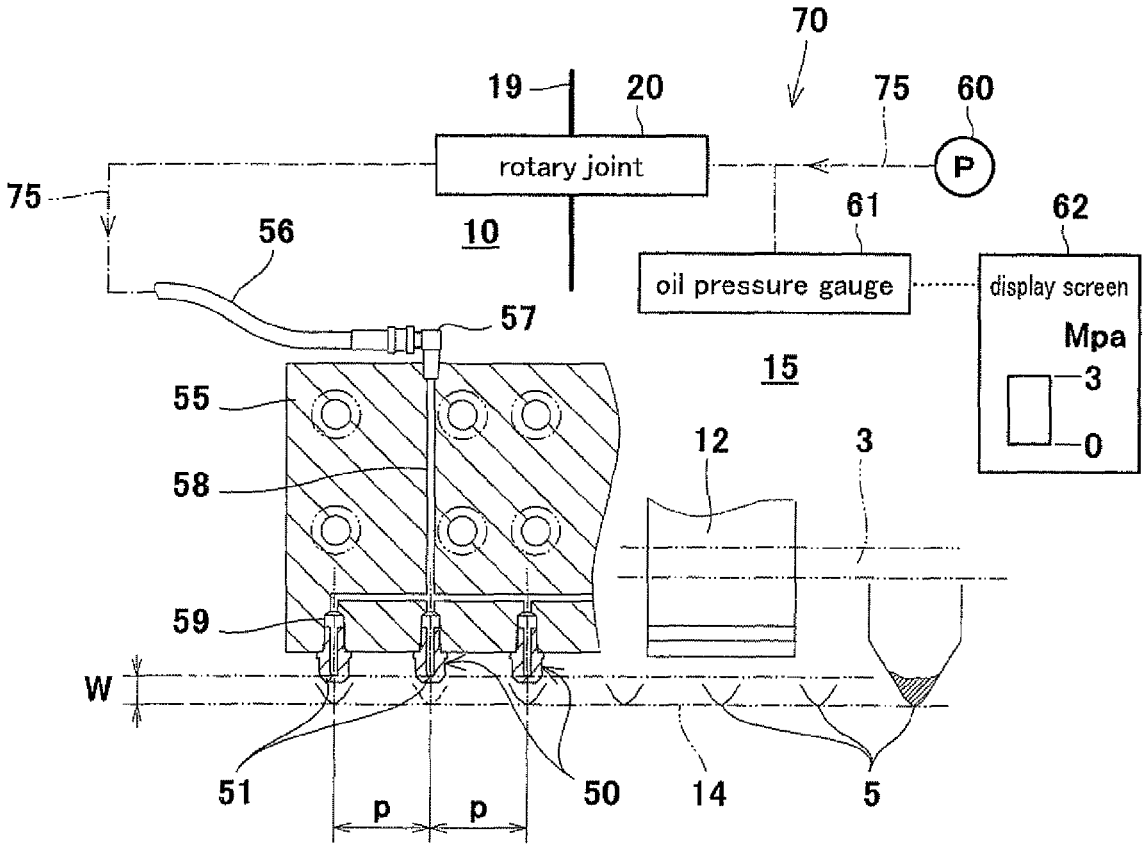
FIG. 5 is a partially enlarged view of a portion indicated by V shown in FIG. 4 and an explanatory diagram showing the abrasion detecting apparatus according to Embodiment 1.

Further, in the present embodiment, a plurality of tool bits 12 are arranged in the radial direction at predetermined intervals on a side of the cutter head frame 3 which side faces the sand intake port 8. These tool bits 12 are provided to excavate the soft ground at a position rearward of the roller cutter 5 but forward of the cutter head frame 3 in a case where the soft ground, which is difficult for the roller cutters 5 to excavate, appears during the excavation of the hard ground by the roller cutters 5 (FIG. 5).

Figure 2:
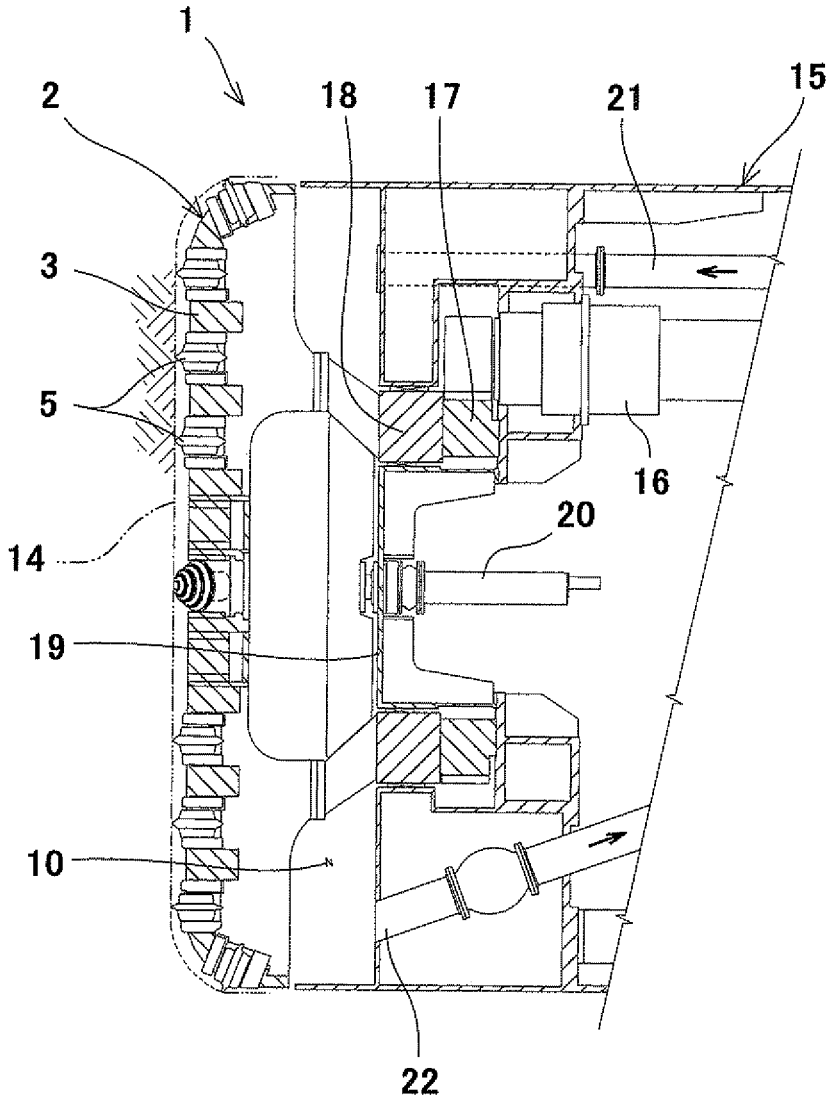
FIG. 2 is a side view showing a vertical cross section of the tunnel boring machine shown in FIG. 1.

As shown in FIG. 2, the cutter head 2 is rotatably provided at a front portion of a tunnel boring machine main body 15, and a front end of each roller cutter 5 configured to excavate a ground 14 is a front end of the cutter head 2. The cutter head 2 is rotated by a turning frame 18 which is turned by a turning gear 17 which is rotated by a driving machine 16 provided in the tunnel boring machine main body 15. The chamber 10 is formed behind the cutter head 2, that is, between the cutter head 2 and a bulkhead 19 provided at a front surface of the tunnel boring machine main body 15, and the sand and the like excavated by the roller cutters 5 of the cutter head 2 are taken through the sand intake port 8 (FIG. 1) into the chamber 10. A rotary joint 20 is provided at a turning center of the cutter head 2. Oil, electric power, and the like are supplied through the rotary joint 20 to the cutter head 2 that is a rotating body.

Moreover, a slurry feed pipe 21 which feeds slurry into the chamber 10 to apply slurry pressure to the excavated ground is provided at an upper portion of the tunnel boring machine main body 15. A slurry discharge pipe 22 through which the sand and the like taken in the chamber 10 is discharged together with the slurry is provided at a lower portion of the tunnel boring machine main body 15. These are configured in accordance with an excavation method, a method for discharging excavated sand, and the like.

Figure 3:
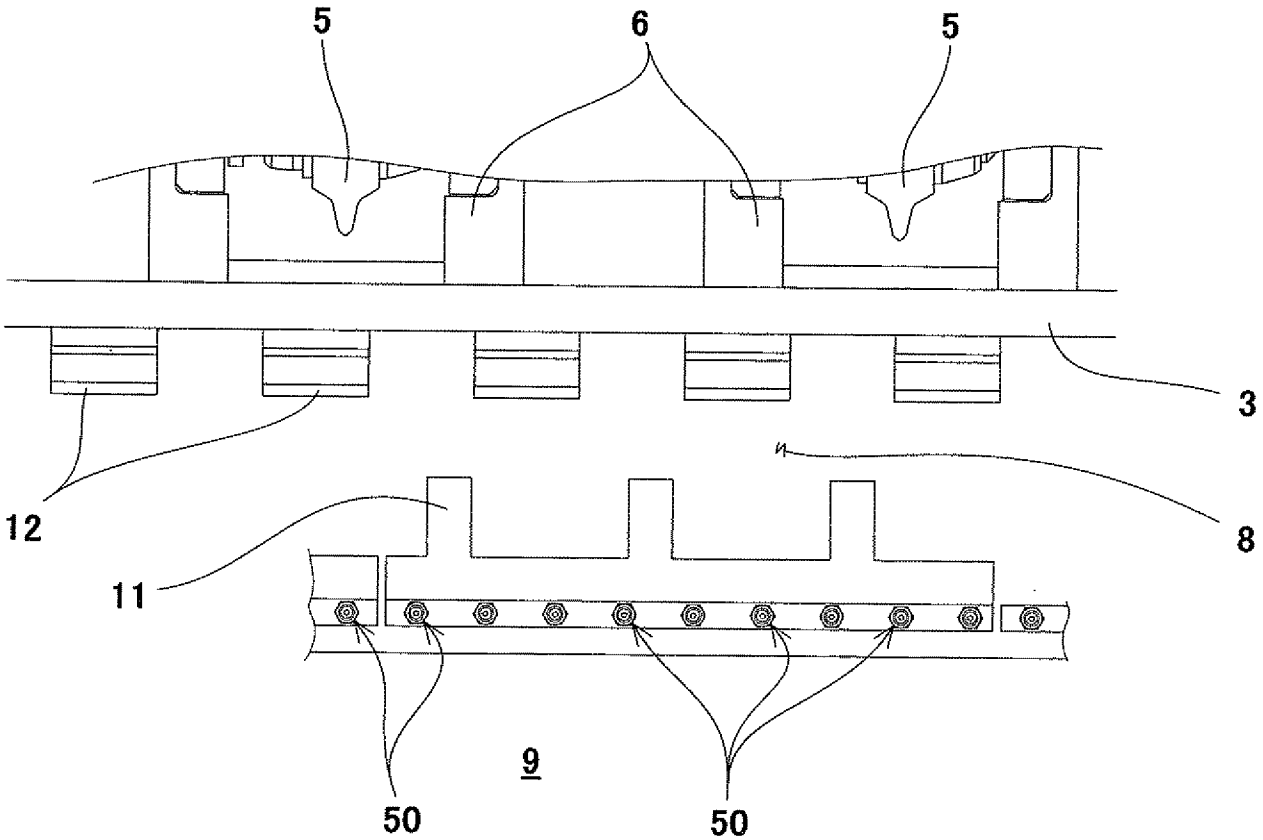
FIG. 3 is a partially enlarged view of a portion indicated by III in FIG. 1.

A plurality of abrasion detection probes 50 (FIG. 3) are provided at the sand intake port 8 (FIG. 1) of the cutter head 2 of the tunnel boring machine 1. As shown in FIG. 3, a plurality of abrasion detection probes 50 are provided at predetermined intervals in the radial direction (longitudinal direction) of the sand intake port 8 and are provided at a base portion of the slit adjusting plate 11. Moreover, the abrasion detection probe 50 of the present embodiment is a fluid pressure type abrasion detection probe configured to detect the abrasion from a change in a fluid pressure. The following will explain an example using oil pressure as the fluid pressure.

Figure 4:
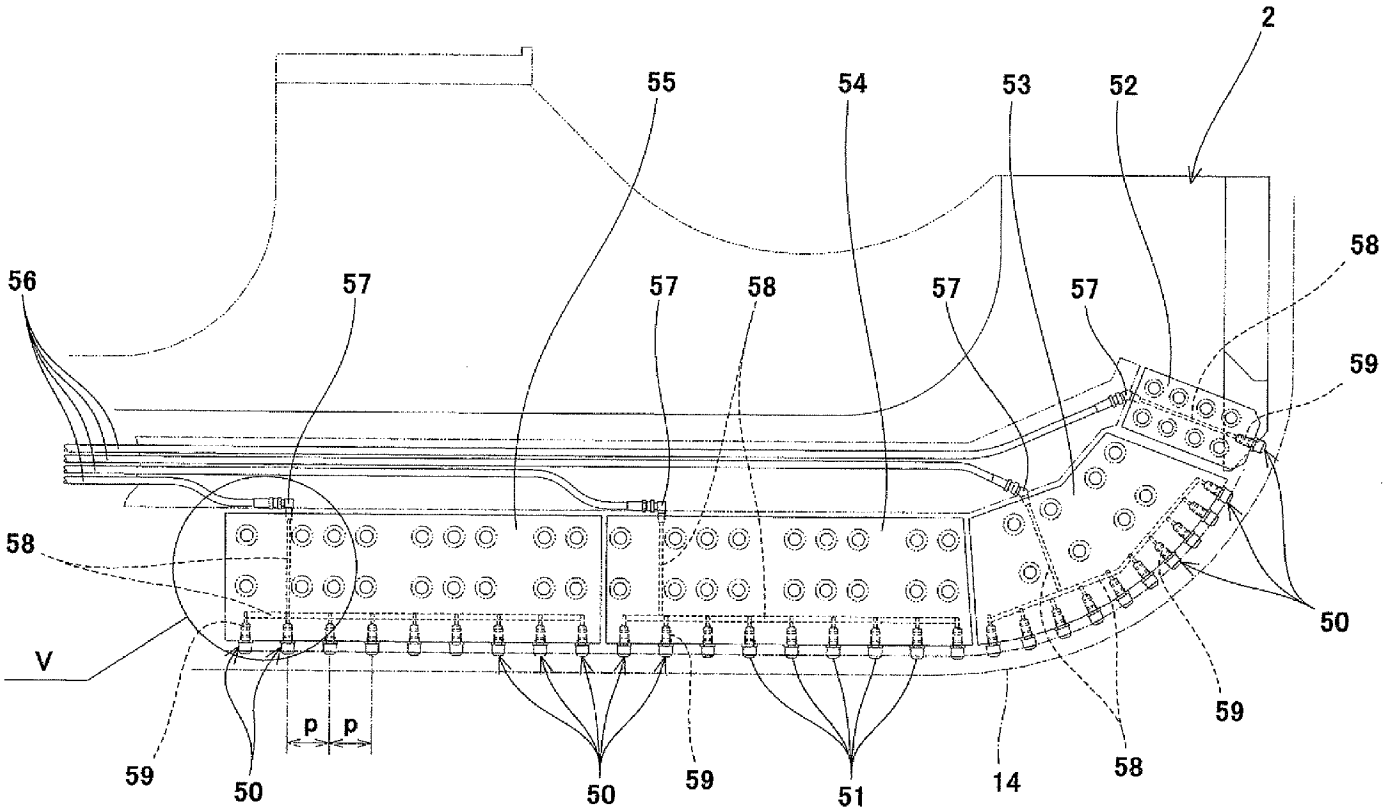
FIG. 4 is an enlarged cross-sectional view when viewed from a direction indicated by an arrow IV shown in FIG. 1.

As shown in FIG. 4, when viewed from the direction indicated by the arrow IV of FIG. 1, a front end of the abrasion detection probe 50 is an abrasion detecting portion 51. The abrasion detection probe 50 is attached such that the abrasion detecting portion 51 faces the ground 14. A radial interval p between adjacent abrasion detection probes 50 corresponds to an interval between the rotation radiuses of adjacent roller cutters 5 (FIG. 1) of the cutter head 2. In the present embodiment, the abrasion detection probes 50 are respectively provided on rotational trajectories of all the roller cutters 5 in order to detect the abrasion losses of all the roller cutters 5. The abrasion detection probes 50 may selectively detect the abrasion of some roller cutters 5 and do not have to be provided for all the roller cutters 5.

In this example, the plurality of abrasion detection probes 50 are separately provided in a plurality of arrangement blocks 52 to 55. In this example, four arrangement blocks 52 to 55 are arranged in the radial direction. The arrangement block 52 is provided for the roller cutter 5 arranged at an outermost position. The arrangement block 53 is provided for a plurality of roller cutters 5 arranged at an outer peripheral portion of the cutter head 2. The arrangement block 54 is provided for a plurality of roller cutters 5 arranged at an outer peripheral portion of a front surface of the cutter head 2. The arrangement block 55 is provided for a plurality of roller cutters 5 arranged at the center portion of the cutter head 2.

A joint portion 57 is provided at each of the arrangement blocks 52 to 55. An oil pressure pipe 56 connected to the rotary joint 20 (FIG. 2) provided at the center portion of the cutter head 2 is connected to the joint portion 57. An oil passage 58 is formed inside each of the arrangement blocks 52 to 55 so as to be communicated with the joint portion 57. The oil passage 58 is formed to be communicated with an attaching portion 59 of each abrasion detection probe 50. Therefore, by respectively providing the abrasion detection probes 50 at the attaching portions 59, each of the abrasion detection probes 50 is communicated with the oil pressure pipe 56 via the oil passage 58 and the joint portion 57.

In the present embodiment, the abrasion detection probes 50 are provided at the slit adjusting plate 11. However, the abrasion detection probes 50 may be incorporated in the cutter head frame 3. Moreover, in the present embodiment, the oil pressure pipes 56 are connected to four arrangement blocks 52 to 55. However, the oil pressure pipes 56 may be individually connected to the abrasion detection probes 50. Further, the number of blocks is not limited to four and may be the other number.

As shown in FIG. 5, the abrasion detection probe 50 of an abrasion detecting apparatus 70 according to Embodiment 1 is provided at such a position that the abrasion detection probe 50 can detect that the abrasion loss of the roller cutter 5 has reached a set abrasion loss w. To be specific, the abrasion detection probe 50 of the present embodiment is provided at such a position that the abrasion detecting portion 51 located at the frond end of the abrasion detection probe 50 abrades away when the abrasion loss of the roller cutter 5 has reached the set abrasion loss w (when a colored portion in the drawing has abraded away).

The oil pressure pipe 56 through which detection oil 75 is supplied to the abrasion detection probe 50 is connected through the rotary joint 20 to an oil pressure pump 60 in the tunnel boring machine main body 15. The pressure of the detection oil 75 supplied from the oil pressure pump 60 is detected by an oil pressure gauge 61. This pressure is displayed on a display screen 62 of, for example, a monitor that is a display apparatus provided at the tunnel boring machine main body 15. In this example, the reduction of the pressure of the detection oil 75 is displayed on the display screen 62. However, a warning may be displayed on the display screen 62, or a buzzer sound or the like may be produced.

In accordance with the abrasion detecting apparatus 70, the abrasion detection probe 50 is provided at a position which is behind the front end of the cutter head 2, that is, the front end of the roller cutter 5 by a certain distance (set abrasion loss w). With this, before the roller cutter 5 abrades away or is damaged, the abrasion detecting portion 51 of the abrasion detection probe 50 does not contact the ground 14, and the roller cutter 5 excavates the ground 14. When the roller cutter 5 abrades away or is damaged, the ground 14 at this position is not excavated but remains. Therefore, the abrasion detecting portion 51 of the abrasion detection probe 50 at this position contacts the ground 14 to abrade away. Then, when the abrasion loss reaches the set abrasion loss w, the detection oil 75 acting on the abrasion detection probe 50 is released, and this decreases the oil pressure of the oil pressure pipe 56. Thus, the abrasion or damage of the roller cutter 5 at the position where the oil pressure has been decreased can be detected.

Figure 6:
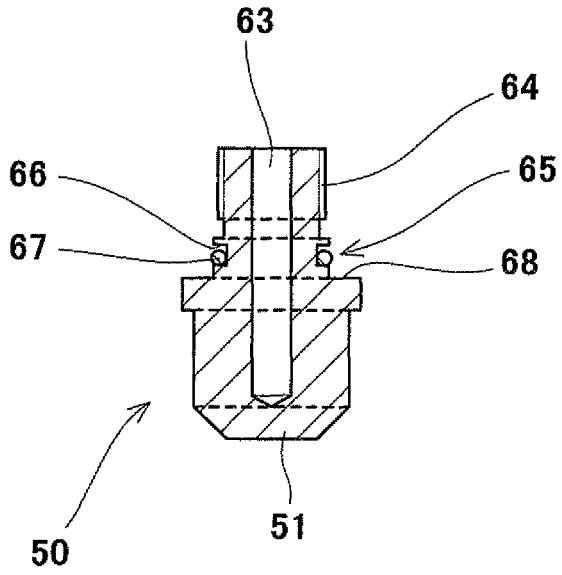
FIG. 6 is an enlarged cross-sectional view of an abrasion detection probe shown in FIG. 5.

As shown in FIG. 6, the abrasion detection probe 50 is a plug-shaped member including an internal oil passage 63 whose front end portion is closed. The front end portion of the internal oil passage 63 is the abrasion detecting portion 51. An attachment external screw portion 64 is formed at a rear end portion of the abrasion detection probe 50, and a sealing portion 65 is formed forward of the external screw portion 64. The sealing portion 65 includes an O ring groove 66, and an O ring 67 is provided at the O ring groove 66. A flange portion 68 is formed at a front end portion of the sealing portion 65. When fixing the abrasion detection probe 50 by screwing the external screw portion 64 into an internal screw portion (not shown) formed at the attaching portion 59 of the arrangement blocks 52 to 55 (FIG. 4), the flange portion 68 contacts the arrangement blocks 52 to 55 to realize the positioning of the abrasion detection probe 50. As above, the abrasion detection probe 50 is a replaceable attachment-type device.

The abrasion detection by the abrasion detecting apparatus 70 will be explained below based on FIGS. 7A to 7D. The following will be explained based on the directions shown in FIG. 4 (the front end is downward).

Figure 7A:
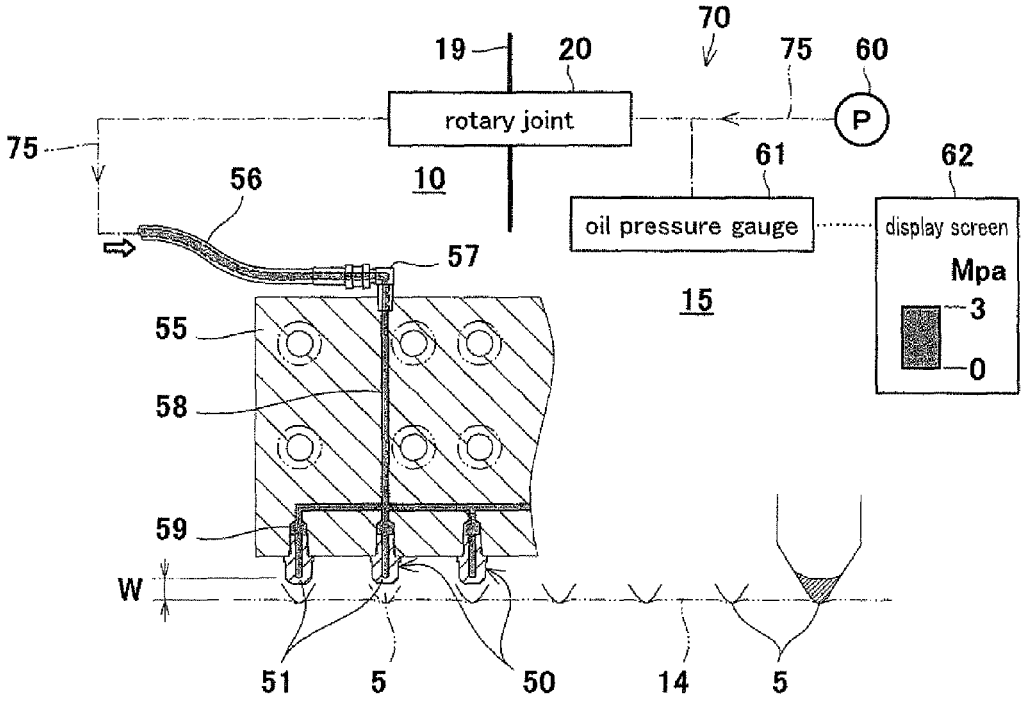
FIG. 7A is an explanatory diagram for sequentially explaining abrasion detection carried out by the abrasion detecting apparatus.

In accordance with the tunnel boring machine 1 including the abrasion detecting apparatus 70, the cutter head 2 excavates while rotating, so that a plurality of roller cutters 5 provided at the cutter head 2 rotate at the front surface of the cutter head 2. With this, the hard ground 14 located on the rotational trajectories of the plurality of roller cutters 5 is crushed. Thus, the ground in front of the entire surface of the cutter head 2 can be excavated (FIG. 7A).

Figure 7B:
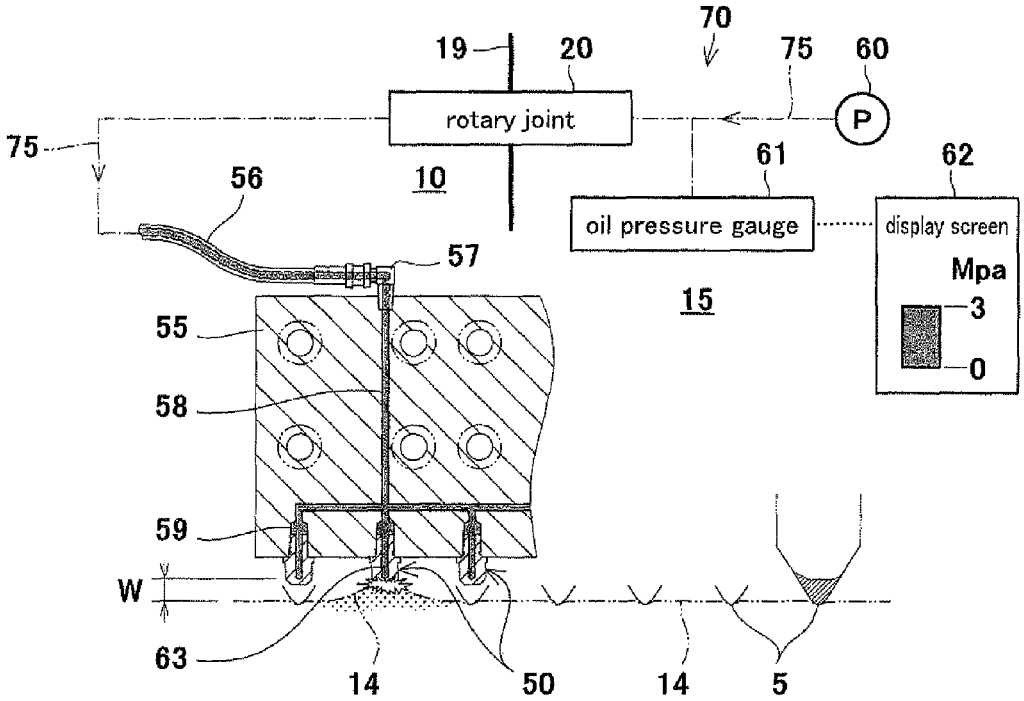
FIG. 7B is an explanatory diagram for sequentially explaining the abrasion detection carried out by the abrasion detecting apparatus.

Then, for example, in a case where the abrasion loss of each of some of the roller cutters 5 has reached the set abrasion loss or some of the roller cutters 5 have been damaged for any reason, the ground 14 located on the rotational trajectory of these roller cutter 5 (the roller cutter 5 located second from left in FIG. 7B) is not excavated. Therefore, the ground 14 reaches the abrasion detecting portion 51 (front end portion) of the abrasion detection probe 50 provided on the rotational trajectory of the abraded or damaged roller cutter 5, and the abrasion detecting portion 51 of the abrasion detection probe 50 abrades away by the ground 14 due to the turning cutter head 2. After that, this state continues, so that the abrasion detecting portion 51 of the abrasion detection probe 50 abrades away, and the front end portion of the internal oil passage 63 opens (FIG. 7B).

Figure 7C:
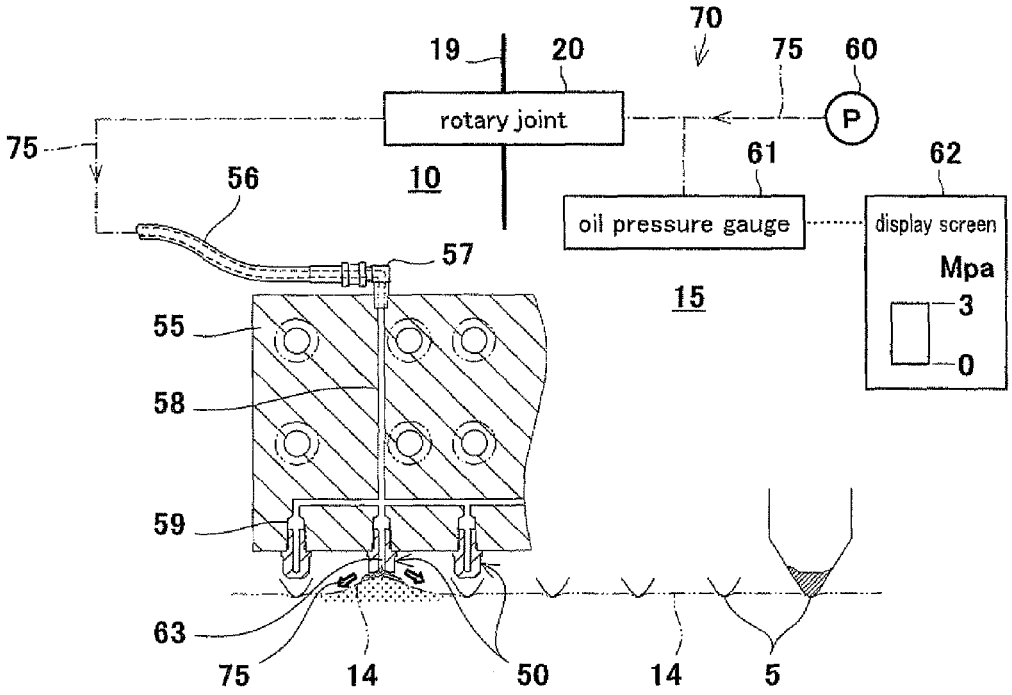
FIG. 7C is an explanatory diagram for sequentially explaining the abrasion detection carried out by the abrasion detecting apparatus.

With this the detection oil 75 in the internal oil passage 63 of the abrasion detection probe 50 leaks from the front end of the abrasion detection probe 50 (FIG. 7C). The pressure of the oil pressure gauge 61 reduces by the leakage of the detection oil 75, and this reduction of the pressure of the detection oil 75 is displayed on the display screen 62. Therefore, an operator can recognize the abrasion of the roller cutter 5 by confirming the reduction of the oil pressure displayed on the display screen 62.

The abrasion of the roller cutter 5 is detected by the abrasion of the abrasion detecting portion 51 of the abrasion detection probe 50. Therefore, even in a hostile environment, such as a case where the sand and the gravel exist at the front surface of the cutter head 2 and in the chamber 10, it is possible to detect that the roller cutter 5 has reached the set abrasion loss w, without being inhibited by the sand, the gravel, and the like. In addition, monitoring can be carried out regardless of during the excavation or the stopping. To be specific, the existence of a non-excavated portion due to the abrasion of the cutting edge of the roller cutter 5 is detected by the abrasion of the abrasion detecting portion 51 of the abrasion detection probe 50. Therefore, the existence of the non-excavated portion can be detected regardless of normal abrasion or partial abrasion.

Moreover, since the abrasion detection probes 50 are separately provided in a plurality of arrangement blocks 52 to 55 as described above, the position of the abraded abrasion detection probe 50 can be confirmed by the block before a replacement operation.

Figure 7D:
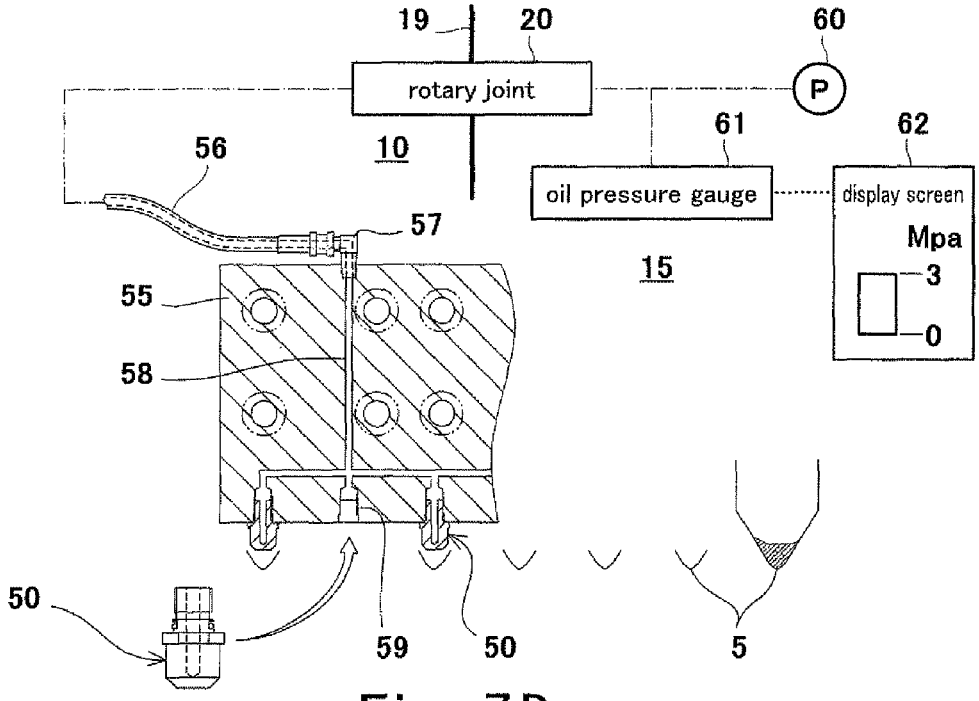
FIG. 7D is an explanatory diagram for sequentially explaining the abrasion detection carried out by the abrasion detecting apparatus.

Then, after the operator recognizes the abrasion of the component of the cutter head 2 and stops the tunnel boring machine 1, the ground improvement around the cutter head 2, the pressure reduction and cleaning in the chamber 10, and the like are carried out. Then, the abraded roller cutter 5 and the abrasion detection probe 50 having the abraded abrasion detecting portion 51 at the front end are replaced with new ones (FIG. 7D). As described above, the roller cutter 5 and the abrasion detection probe 50 are replaced after it is confirmed by the abrasion detection probe 50 that the abrasion loss of the roller cutter 5 has reached the set abrasion loss w. Therefore, the replacement is carried out after the need for the replacement and the position of the replacement are confirmed. Therefore, the replacement can be efficiently carried out.

As above, in accordance with the abrasion detecting apparatus 70, when the tip end portion (colored portion in the drawing) of the roller cutter 5 abrades away and the abrasion loss of the roller cutter 5 reaches the set abrasion loss w, the abrasion detecting portion 51 of the abrasion detection probe 50 also abrades away by this abrasion loss, and the detection oil 75 leaks from the front end of the abrasion detection probe 50. With this, the detection oil 75 in the oil passage 58, through which the detection oil 75 is acting on the abrasion detection probe 50, is reduced in pressure, the pressure reduction of the detection oil 75 is detected by the oil pressure gauge 61 configured to measure the pressure of the oil pressure pipe 56, and this pressure reduction can be easily recognized by the display of the pressure shown on the display screen 62. Therefore, by monitoring the pressure of the detection oil 75 displayed on the display screen 62, the operator can easily recognize that the abrasion loss of the roller cutter 5 has reached the set abrasion loss w.

In addition, in accordance with the abrasion detecting apparatus 70, each of the roller cutters 5 and the cutter holders 6 does not have to include a special mechanism for the abrasion detection, and normal roller cutters and normal cutter holders can be used. In addition, the abrasion detection probe 50 can be incorporated in a component (the slit adjusting plate 11, the tool bit 12, or the like) mounted on the cutter head 2 or in the frame 3 of the cutter head 2, so that space saving can be realized.

Figure 8:
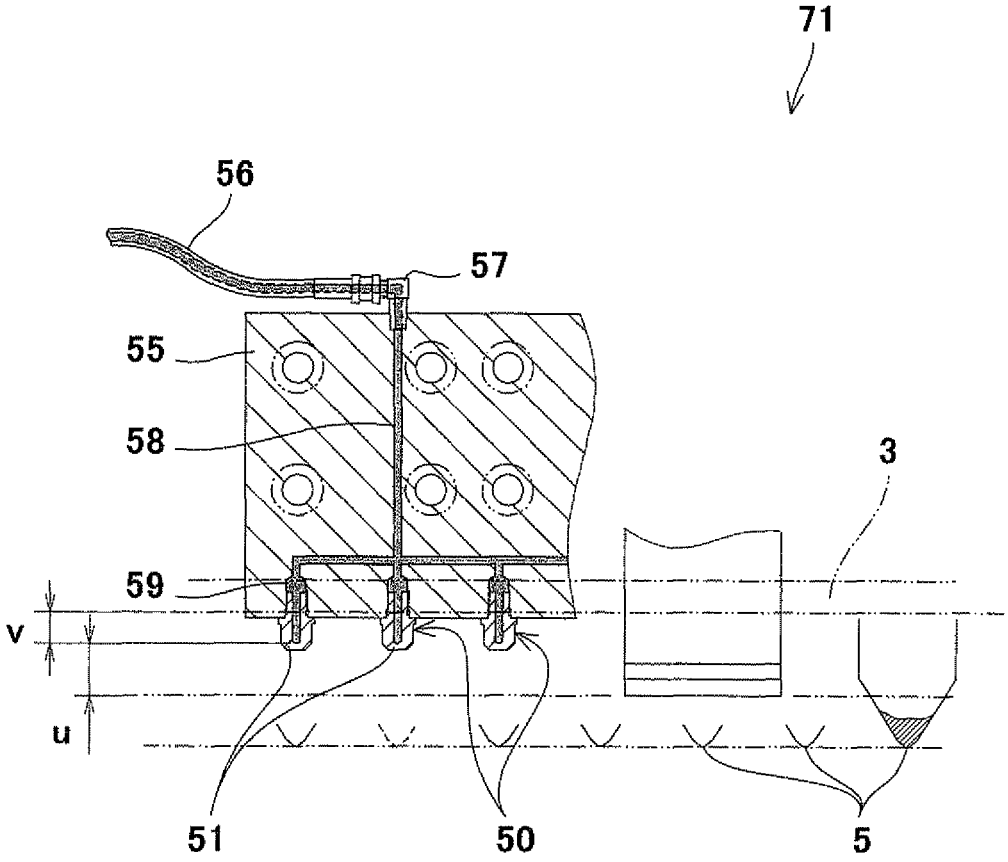
FIG. 8 is an explanatory diagram showing the abrasion detection probe of the abrasion detecting apparatus according to Embodiment 2 of the present invention.

An abrasion detecting apparatus 71 according to Embodiment 2 shown in FIG. 8 is one example of preventing the cutter head frame 3, which is a component other than the roller cutter 5 of the cutter head 2, from abrading away by the abrasion detection probe 50. The same reference numbers are used for the same components as in Embodiment 1, and detailed explanations thereof are omitted.

As shown in FIG. 8, in Embodiment 2, each of the abrasion detecting portions 51 of the abrasion detection probes 50 is provided to project from the front surface of the cutter head frame 3 by a predetermined distance v and be located rearward of the front end of the tool bit 12 by a predetermined distance u.

The abrasion detection probes 50 are provided as above. With this, even if the roller cutter 5 and the tool bit 12 abrade away or are damaged due to any reason, the abrasion detecting portion 51 abrades away before the abrasion of the cutter head frame 3, and this leaks the detection oil 75. Therefore, it is possible to detect that the non-excavated ground 14 is close to the cutter head frame 3. On this account, before the cutter head frame 3 abrades away, the abrasion, the damage, or the like of the roller cutter 5 and the tool bit 12 can be recognized. Therefore, the cutter head frame 3 which is almost irreplaceable among the components of the cutter head 2 can be prevented from abrading away.

The space saving can be realized by incorporating the abrasion detection probe 50 of the present embodiment in a component (the slit adjusting plate 11, or the like) mounted on the cutter head 2 or in the frame 3 of the cutter head 2.

Embodiment 1 has explained an example in which the abrasion of the roller cutter 5 is detected, and Embodiment 2 has explained an example in which the abrasion is detected to prevent the cutter head frame 3 from abrading away. However, for example, the abrasion of the tool bit 12 can also be detected by arranging the abrasion detecting portion 51 of the abrasion detection probe 50 such that the abrasion detecting portion 51 is located rearward of the front end of the tool bit 12 by a predetermined distance corresponding to the set abrasion loss. To be specific, by changing the position of the tip end of the abrasion detection probe 50, the abrasion detection of the tool bit 12 attached rearward of the roller cutter 5 can be carried out in addition to the roller cutter 5, and the detection for preventing the cutter head frame 3 located further rearward of the tool bit 12 from abrading away can also be carried out.

Further, by arranging the abrasion detection probe 50 configured to detect that the abrasion loss of the roller cutter 5 has reached the set abrasion loss as in Embodiment 1, the abrasion detection probe 50 (not shown) configured to detect that the abrasion loss of the tool bit 12 has reached the set abrasion loss, and the abrasion detection probe 50 configured to prevent the cutter head frame 3 from abrading away, the abrasions of the components of the cutter head 2 can be stably detected, and the tunnel boring machine 1 can be stably operated.

As above, for a component, whose abrasion needs to be detected, of the cutter head 2, the abrasion detection probe 50 for the abrasion detection is provided at a position (certain distance rearward position) rearward of the front end of the cutter head 2 by a certain distance. With this, the non-excavated portion of the ground 14 generated by the abrasion or damage of the component of the cutter head 2 contacts the abrasion detecting portion 51 of the abrasion detection probe 50, and the abrasion detecting portion 51 abrades away. Thus, the abrasion or damage of the component whose abrasion needs to be detected can be detected.

Figure 9A:
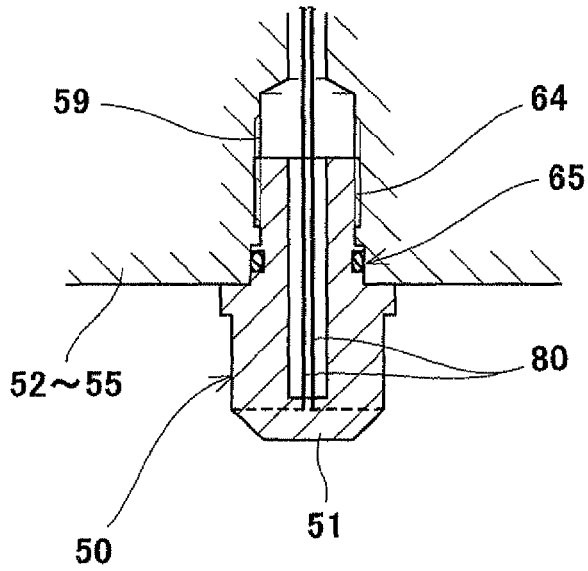
FIG. 9A is a cross-sectional view showing one example of an electric type detection probe.
Figure 9B:
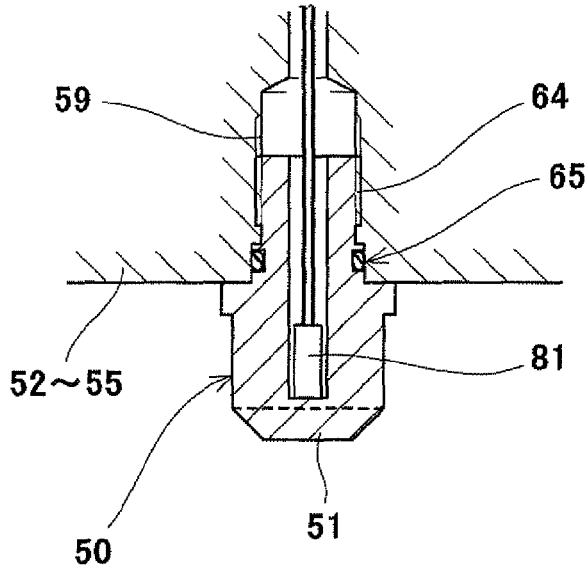
FIG. 9B is a cross-sectional view showing one example of an ultrasound type detection probe.

As shown in FIGS. 9A and 9B, each of Embodiments 1 and 2 has explained an example in which the abrasion detection probe 50 is constituted by an oil-pressure type detection probe. However, the abrasion detection probe 50 may be constituted by an electric type detection probe. In this case, electric wires 80 are provided at the abrasion detecting portion 51 located at the front end portion of the abrasion detection probe 50 (FIG. 9A), and a resistance value between these electric wires 80 is measured to be compared with an initial value. With this, the condition of the abrasion of the front end portion of the abrasion detection probe 50 can be detected based on the change in the resistance value.

In a case where the abrasion detection probe 50 is constituted by the electric type detection probe, its configuration is comparatively simple, and its cost is comparatively low.

Moreover, the abrasion detection probe 50 may be an ultrasound type detection probe (FIG. 9B). In this case, an ultrasound probe 81 is embedded in the front portion of the abrasion detection probe 50, and the thickness of the abrasion detecting portion 51 located at the front end portion of the abrasion detection probe 50 is obtained by a signal of the ultrasound probe 81 based on a sound wave propagation time. The abrasion loss can be detected by the change in the thickness. In a case where the abrasion detection probe 50 is constituted by the ultrasound type detection probe, the change in the abrasion loss can be continuously measured.

As above, various mechanisms, such as an electric type, an ultrasound type, or an oil-pressure type, can be adopted as a mechanism of the abrasion detection probe 50 configured to detect the abrasion. Which one is adopted may be determined depending on the condition of the ground, the use condition, and the like.

As above, in accordance with the abrasion detecting apparatuses 70 and 71, the abrasion (regardless of normal abrasion or partial abrasion) of the component of the cutter head 2 of the tunnel boring machine 1 can be monitored and detected by the abrasion detection probe 50 regardless of during the excavation or the stopping. Therefore, in the tunnel boring machine 1 configured to excavate the hard ground, the roller cutter 5 and the like which have heavily abraded away can be appropriately replaced with new ones, so that the excavation of the tunnel boring machine 1 can proceed as planned.

In Embodiment 1, the detection oil 75 is supplied through one oil pressure pipe 56 to each of the arrangement blocks 52 to 55 in each of which a plurality of abrasion detection probes 50 are provided. Therefore, the condition of the abrasion of the roller cutter 5 can be detected by the arrangement blocks 52 to 55. However, the oil pressure pipes 56 may be respectively connected to the abrasion detection probes 50, and each abrasion detection probe 50 may detect the abrasion.

Moreover, instead of providing the abrasion detection probes 50 on the rotational trajectories of all the roller cutters 5, a plurality of abrasion detection probes 50 may be provided on the rotational trajectories of a plurality of components of the cutter head 2, such as the rotational trajectories of the roller cutters 5 located at positions where the abrasion tends to occur. The positions of the abrasion detection probes 50, the number of abrasion detection probes 50, and the like are not limited to those in the above embodiments.

Further, the abrasion detection probes 50 configured to detect the set abrasion loss of the roller cutter 5 explained in Embodiment 1, the abrasion detection probes 50 configured to detect the set abrasion loss of the tool bit 12, and the abrasion detection probes 50 configured to prevent the cutter head frame 3 explained in Embodiment 2 from abrading away may be provided separately or in combination.

Moreover, the above embodiments are just examples. Various modifications may be made within the scope of the present invention. The present invention is not limited to the above embodiments.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An abrasion detecting apparatus configured to detect abrasions of a plurality of components of a cutter head of a tunnel boring machine configured to excavate a ground using a cutter to bore a tunnel, the abrasion detecting apparatus comprising;

abrasion detection probes respectively including at front end portions thereof abrasion detecting portions which abrade away by contact with the ground to be excavated, the abrasion detecting portions being located rearward of a front end of the cutter by a first distance and located forward or rearward of front ends of the plurality of components, whose abrasions need to be detected, of the cutter head by a second distance, the abrasion detecting portions projecting forward from a front surface of a cutter head frame by a third distance; and a detecting device configured to detect an abrasion of the abrasion detecting portion, wherein:

attachment external screw portions are respectively formed at rear end portions of the abrasion detection probes, and sealing portions are respectively formed forward of the external screw portions, the sealing portions respectively including O-ring grooves, and O-rings being respectively provided at the O-ring grooves; and the abrasion detection proves are detachably attached onto a slit adjusting plate of the cutter head so as to be respectively provided on rotational trajectories of the plurality of components of the cutter head, the abrasion detection probes respectively detecting abrasion losses of the plurality of components, the slit adjusting plate being configured to adjust a size of an opening of a sand intake port provided between the cutter head frame and the slit adjusting plate.

2. The abrasion detecting apparatus according to claim 1, wherein each of the abrasion detecting portions is provided at a position which is located rearward of a front end of a roller cutter provided at the cutter head by a predetermined distance and corresponds to a set abrasion loss of the roller cutter.

3. The abrasion detecting apparatus according to claim 2, wherein each of the abrasion detection probes is provided on a rotational trajectory of each of a plurality of the roller cutters provided at the cutter head such that the abrasion detection probes are arranged in a radial direction of the cutter head.

4. The abrasion detecting apparatus according to claim 1, wherein each of the abrasion detecting portions is provided at a position which is located rearward of a front end of a tool bit provided at the cutter head by a predetermined distance and corresponds to a set abrasion loss of the tool bit.

5. The abrasion detecting apparatus according to claim 1, wherein:

the abrasion detection probe is constituted by a fluid-pressure type detection probe configured to detect based on a change in a fluid pressure that the abrasion loss of the abrasion detecting portion has reached the set abrasion loss; and the fluid-pressure type detection probe is configured to apply a predetermined fluid pressure to the abrasion detecting portion and detect based on a reduction in the fluid pressure that the abrasion loss of the abrasion detecting portion has reached the set abrasion loss.

6. The abrasion detecting apparatus according to claim 1, wherein:

the abrasion detection probe is constituted by an ultrasound type detection probe configured to detect based on an ultrasound propagation time that the abrasion loss of the abrasion detecting portion has reached the set abrasion loss; and the ultrasound type detection probe is configured to include an ultrasound probe in the abrasion detecting portion and detect based on the ultrasound propagation time by the ultrasound probe that the abrasion loss of the abrasion detecting portion has reached the set abrasion loss.

7. The abrasion detecting apparatus according to claim 1, wherein:

the abrasion detection probe is constituted by an electric type detection probe configured to detect based on a change in an electrical resistance value that the abrasion loss of the abrasion detecting portion has reached the set abrasion loss; and the electric type detection probe is configured to include electric wires in the abrasion detecting portion and detect based on a change in an electrical resistance value between the electric wires that the abrasion loss of the abrasion detecting portion has reached the set abrasion loss.

8. A tunnel boring machine comprising:

the abrasion detecting apparatus according to claim 1; and a display apparatus configured to display a detection result of the abrasion detecting apparatus.

* * * * *